US008617357B2

(12) United States Patent
Dionne et al.

(10) Patent No.: US 8,617,357 B2
(45) Date of Patent: Dec. 31, 2013

(54) TWIN WIRE PRESS

(75) Inventors: Hugues Dionne, Le Gardeur (CA); Marc-André Hétu, Blainville (CA); Daniel Parenteau, Blainville (CA)

(73) Assignee: Kadant Canada Corp., Summerstown, Ontario (CA)

( * ) Notice: Subject to any disclaimer, the term of this patent is extended or adjusted under 35 U.S.C. 154(b) by 0 days.

(21) Appl. No.: 13/138,601

(22) PCT Filed: Mar. 9, 2010

(86) PCT No.: PCT/CA2010/000346
§ 371 (c)(1),
(2), (4) Date: Nov. 17, 2011

(87) PCT Pub. No.: WO2010/102398
PCT Pub. Date: Sep. 16, 2010

(65) Prior Publication Data

US 2012/0048494 A1 Mar. 1, 2012

(30) Foreign Application Priority Data

Mar. 10, 2009 (CA) ..... 2657627

(51) Int. Cl.
*D21F 1/00* (2006.01)

(52) U.S. Cl.
USPC ..... 162/336

(58) Field of Classification Search
USPC ..... 162/336, 300, 358.1; 100/118, 100/151–154, 170; 210/401, 118, 386
See application file for complete search history.

(56) References Cited

U.S. PATENT DOCUMENTS

| | | | | |
|---|---|---|---|---|
| 3,796,149 | A | 3/1974 | Heissenberger | |
| 3,994,774 | A | 11/1976 | Halme et al. | |
| 4,544,447 | A | 10/1985 | Pinter et al. | |
| 4,681,033 | A | 7/1987 | Crandall et al. | |
| 7,051,882 | B2 * | 5/2006 | Odmark et al. | 210/401 |
| 2008/0110589 | A1 | 5/2008 | Odmark | |

FOREIGN PATENT DOCUMENTS

| | | | |
|---|---|---|---|
| GB | 2 147 820 | A | 5/1985 |
| WO | WO 97/42374 | A1 | 11/1997 |
| WO | 99/01610 | | 1/1999 |
| WO | WO 02/10509 | A1 | 2/2002 |
| WO | 02/10509 | | 7/2002 |

OTHER PUBLICATIONS

Supplementary European Search Report, dated Sep. 24, 2021, for corresponding European Application No. 10750284.1.
International Search Report and Written Opinion mailed Jun. 22, 2010 for PCT/CA2010/00346 filed Mar. 9, 2010.
International Preliminary Report on Patentability mailed Sep. 13, 2011 for PCT/CA2010/000346 filed Mar. 9, 2010.

* cited by examiner

*Primary Examiner* — Mark Halpern
(74) *Attorney, Agent, or Firm* — Wegman, Hessler & Vanderburg

(57) ABSTRACT

A twin wire press for dewatering solid-liquid suspensions, such as pulp suspensions, between top and bottom webs is described herein which includes consecutive primary, secondary and tertiary dewatering sections. The primary dewatering section includes a wedge area. The secondary dewatering section is positioned adjacent to the primary section downstream therefrom and includes grooved rolls in an s-roll configuration. The tertiary dewatering section includes rolls in a scissor-nip configuration. The press rolls in the secondary and tertiary section are all supported onto a frame. Whenever maintenance is to be performed on any one of the grooved rolls or on the press roll assemblies, an overhead crane can for example be used since no frame structure is provided on top thereof.

8 Claims, 7 Drawing Sheets

TWIN WIRE PRESS

This application is a 371 of PCT/CA2010/000346 filed 9 Mar. 2010

FIELD

The invention relates to water removal in solid-liquid suspensions such as pulp suspensions in the paper industry or in the juice industry, sludge and the likes. More specifically, the present invention relates to a twin wire press for such applications.

BRIEF DESCRIPTION OF THE PRIOR ART

Traditional twin wire presses, also called pulp press, comprise a first dewatering section including a wedge area and usually a second dewatering section which includes consecutive S rolls and a third dewatering section including rolls in a nip configuration.

In these traditional twin wire presses, the roll assemblies in the second and third dewatering sections are mounted to a frame which includes top and bottom portions for receiving and operatively supporting the rolls therebetween. This mounting configuration of the roll assemblies is a major drawback since installation, maintenance and repairs of the roll assemblies can only be achieved in a space sufficiently large to accommodate not only the press and but also the above-mentioned operation. Indeed, conventional twin wire presses requires about twice the size of the rolls around the press for their maintenance, etc.

In addition, the roll assemblies in conventional twin wire press are prone to misalignment.

DETAILED DESCRIPTION

Figure 1:
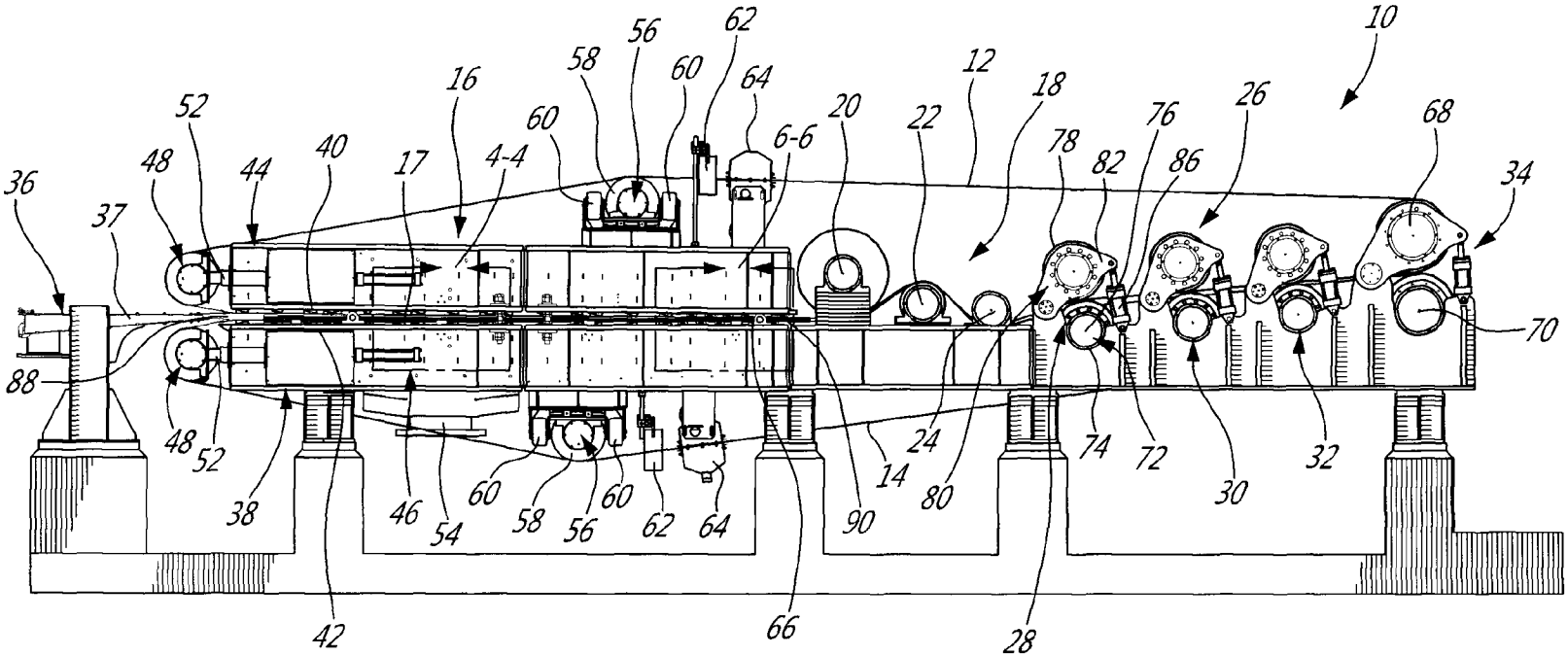
FIG. 1 is a side elevation of a twin wire press according to a first embodiment of the present invention.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

According to embodiments of the present invention, there is provided twin wire press for separating solid and liquid from a primary solid-liquid suspension, the twin wire press comprising:

top and bottom endless webs;

a support frame;

a first dewatering section mounted to the support frame and including a wedge area which has an inlet and an outlet; the first dewatering section further including first and second tension roll assemblies mounted to the support frame upstream the wedge interspace inlet for directing respectively the top and bottom endless webs into the wedge interspace for movement from the inlet to the outlet thereof; the wedge interspace acting on the top and bottom webs in movement therein for collecting a first quantity of liquid from the primary solid-liquid suspension received therein so as to yield at the outlet a secondary solid-liquid suspension which is denser than the primary solid-liquid;

a secondary dewatering section mounted to the support frame adjacent the outlet of the first dewatering section for receiving the secondary solid-liquid suspension therefrom; the secondary dewatering section having a press roll assembly including press rolls which are all mounted onto the support frame; the top and bottom webs cooperating in movement with the press rolls to further extract liquid from the secondary solid-liquid suspension to yield a tertiary solid-liquid suspension; and a drive roll mounted to the support frame that cooperates with first and second tension roll assemblies to move the top and bottom webs from the inlet of the wedge interspace to the second dewatering section via the outlet of the wedge interspace then back to the inlet of the wedge interspace.

The expression press roll is intended herein to include a roll which, alone or in cooperation with another roll, cooperates with a web in a twin wire press to extract liquid from a suspension.

According to further embodiments of the present invention, there is provided a primary dewatering system for a twin wire press including top and bottom endless webs, the primary dewatering system being for separating solid and liquid from a primary solid-liquid suspension, the primary dewatering system comprising:

a support frame;

a pair of opposite superimposed planar static elements which are operatively mounted to the frame so as to yield a wedge interspace therebetween and having first and second longitudinal ends defining respectively an inlet and an outlet of the wedge interspace;

excess liquid removal elements secured to the frame so as to be positioned in the wedge interspace adjacent the outlet thereof; and first and second tension roll assemblies mounted to the frame upstream the wedge interspace inlet for directing respectively the top and bottom endless webs into the wedge interspace for movement from the inlet to the outlet thereof; the top and bottom webs cooperating in movement with the pair of opposite superimposed planar static elements therebetween for collecting a first quantity of liquid from the primary solid-liquid suspension so as to yield at the outlet a secondary solid-liquid suspension which is denser than the primary solid-liquid.

Figure 2:
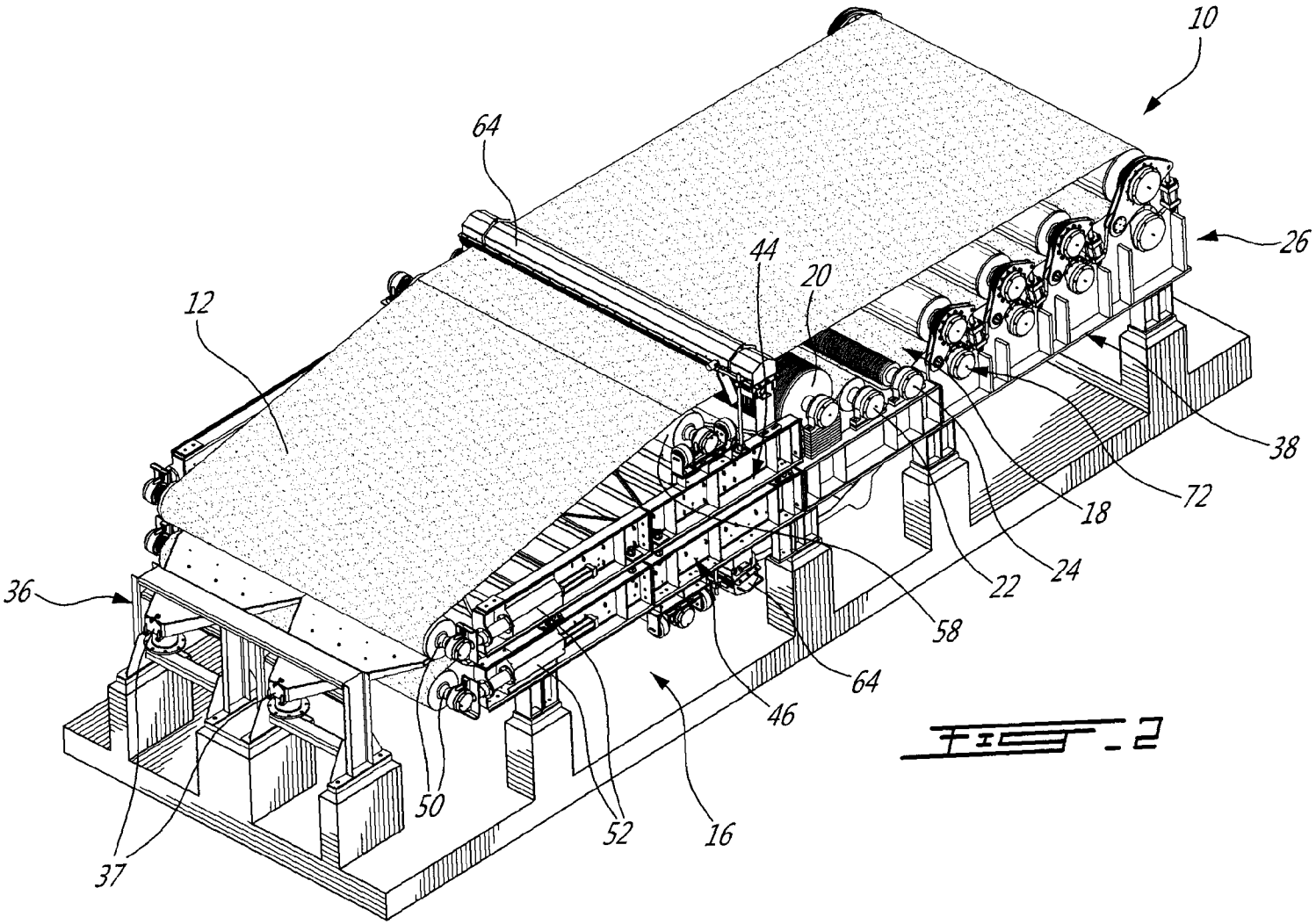
FIG. 2 is a front perspective of the twin wire press from FIG. 1
Figure 3:
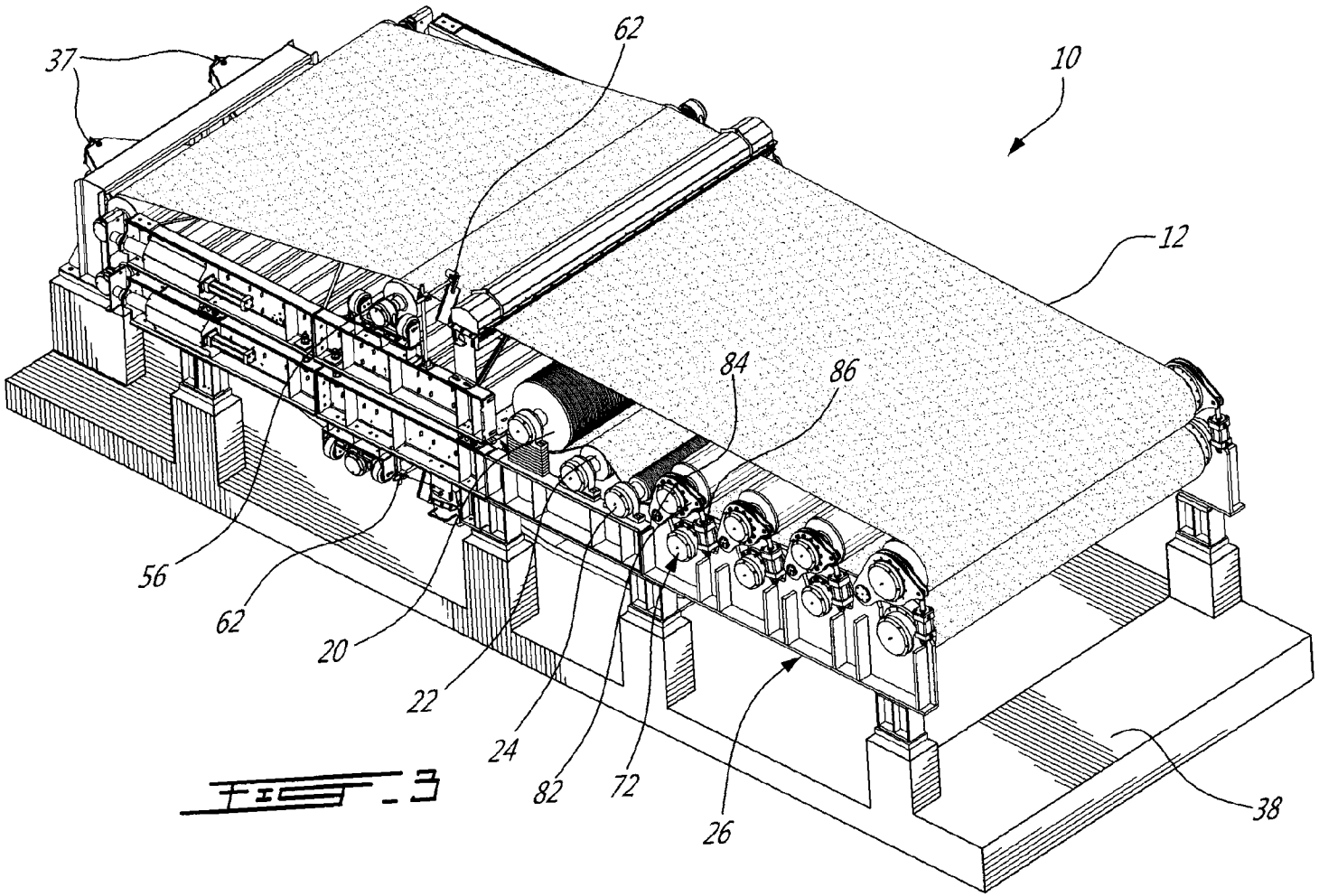
FIG. 3 is a back perspective of the twin wire press from FIG. 1.

With reference to FIGS. 1 to 3, a twin wire press 10 according to a first embodiment will now be described.

The twin wire press 10 allows dewatering solid-liquid suspensions between top and bottom webs 12 and 14.

The twin wire press 10 comprises a primary dewatering section 16 including a wedge area 17, a secondary dewatering section 18, adjacent to the primary section 16 downstream therefrom, including grooved rolls 20-24 in an s-roll configuration, and a tertiary dewatering section 26 including scissor-nip roll assemblies 28-34 adjacent the secondary dewatering section 18 downstream thereof.

The press 10 further comprises a head box 36 located upstream from the wedge area 16 for feeding fiber material to the press 10. The headbox 36 comprises two (2) pressurized pulp feeders 37. It is to be noted that the number and configuration of the feeders 37 may vary depending for example on the width of the press 10 and/or on the nature of the solid-liquid suspension.

The head box 36, primary, secondary and third dewatering sections 16, 18 and 26 are mounted to a bottom frame 38. It is to be noted that no frame element is provided above the secondary and tertiary dewatering sections 18 and 26, and therefore above the S rolls 20 to 24 and press roll assemblies 28 to 34, which are supported only by the bottom frame 38 thereonto.

Figure 4:
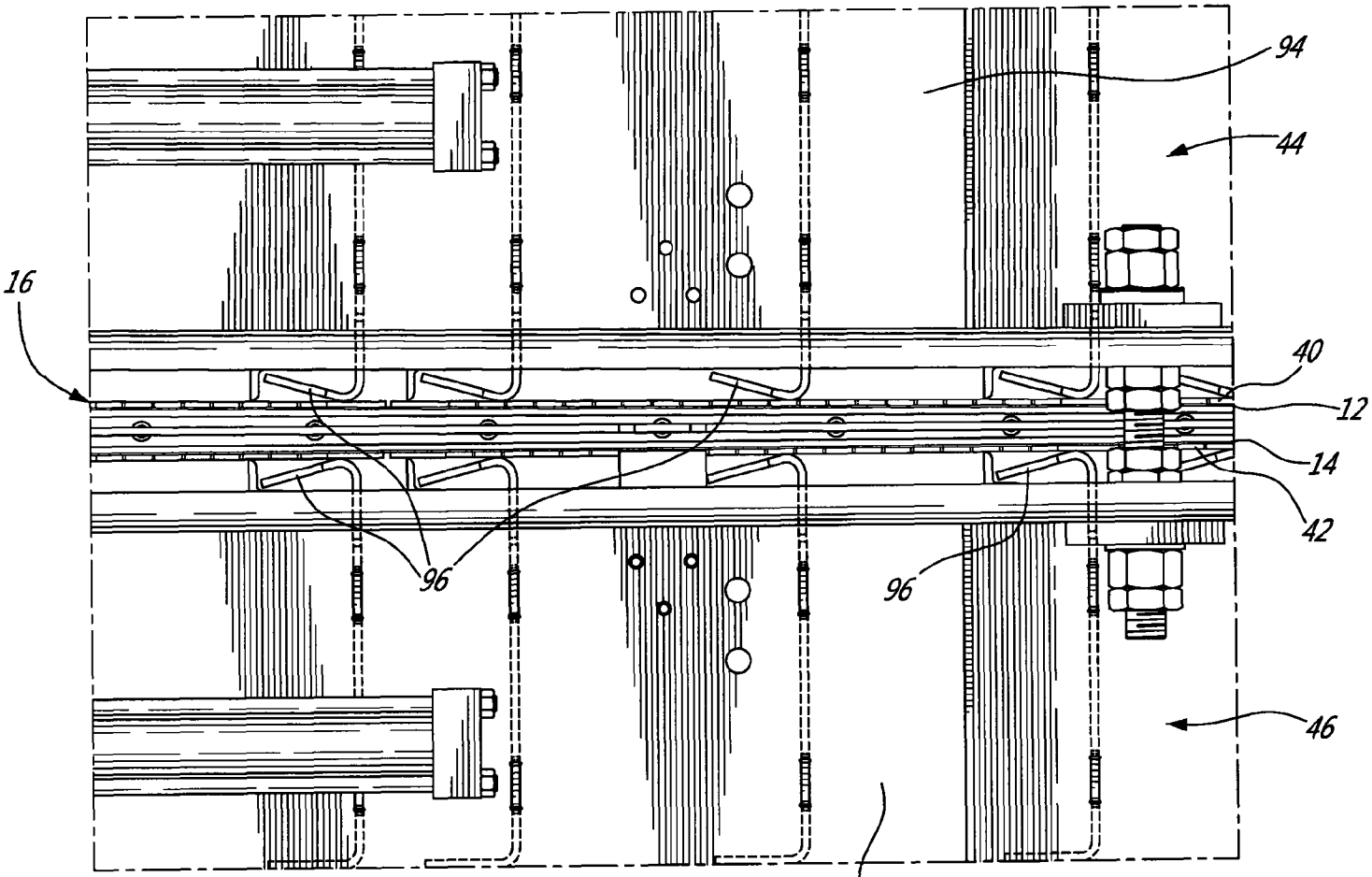
FIG. 4 is a close up view of taken within lines 4-4 in FIG. 1, illustrating the static foil assembly which is part of the primary dewatering section.
Figure 5:
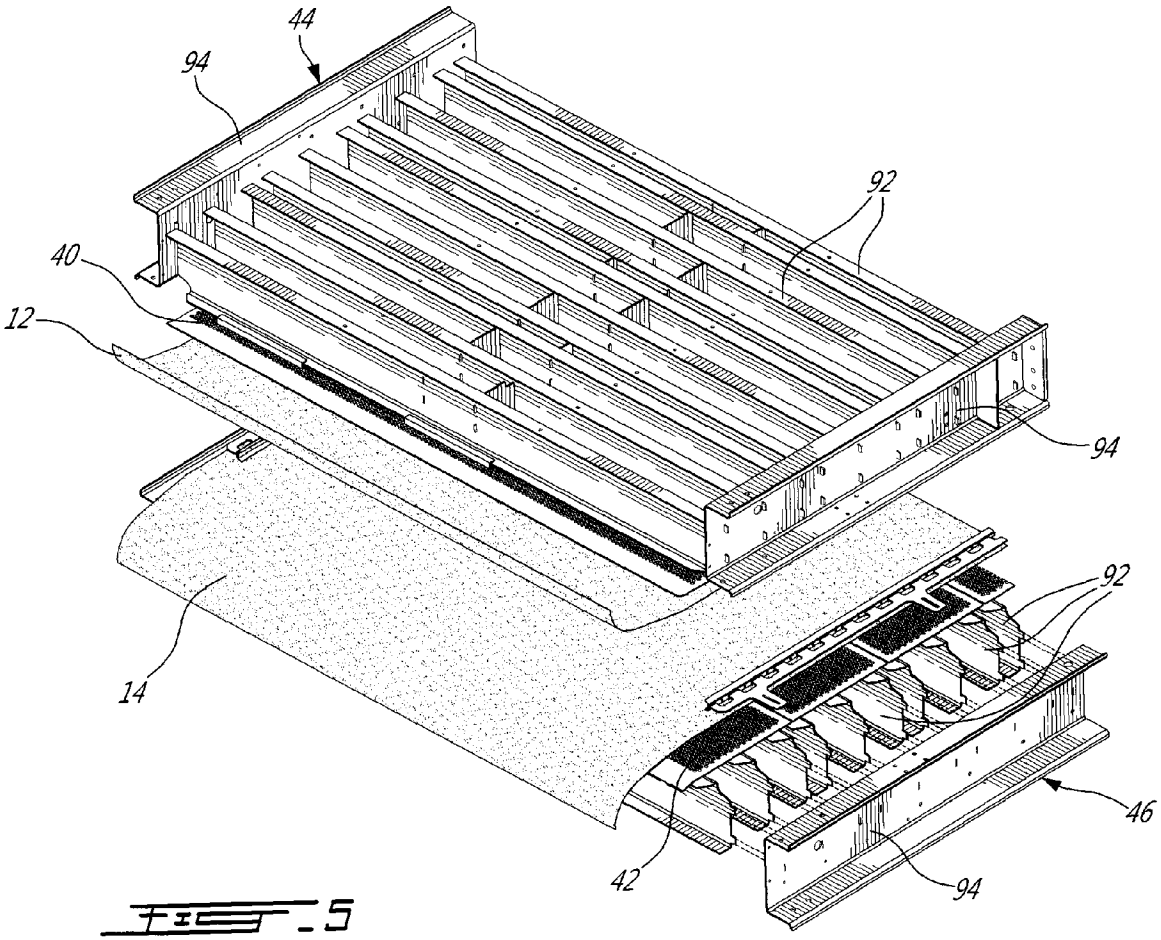
FIG. 5 is an exploded view of the static foil assembly from FIG. 4.

Turning now briefly to FIGS. 4 and 5, the wedge area 16 is defined by superimposed top and bottom static sheets 40 and 42 which are operatively assembled via top and bottom frame assemblies 44 and 46. The bottom frame assembly 46 is part of or assembled to the support frame 38. The interspace 17 between the top and bottom static sheets 40 and 42 has a height which is sufficient to allow passage to the top and bottom webs 12 and 14 and the suspension (not shown), which is injected by the head box 36 between the top and bottom webs 12 and 14. The interspace 17 has a longitudinal inlet end side 88 and a longitudinal outlet side 90 for the solid-liquid suspension. The wedge area 17, which is defined by the interspace, is tapered, with the cross section thereof being greater at the inlet side 88 than at the outlet side 90. The pressure exerted onto the solid-liquid suspension therefore increases from the inlet 88 to the outlet 90.

The static sheets 40 and 42 are perforated to allow passage to liquid therethrough. The top and bottom static sheets 40-42 respectively define the top and bottom plates of respective top and bottom support assemblies 44-46.

Each of the frame assemblies 44 and 46 includes transversal beams 92 secured between two generally parallel longitudinal beams 94 transversally thereof. Each transversal beam 92 includes a bended resilient end 96 extending beyond the beam 94 on the side of the interspace 16. These ends 96 act as biasing members that apply pressure onto the static sheets 40 and 42 so as in the interspace 17. The pressure applied onto the static sheets 40 and 42 is further applied by the static sheets 40 and 42 onto the solid-liquid suspension via the top and bottom webs 12 and 14.

Since the interspace is tapered, more pressure is applied onto solid-liquid suspension therein. The above-described arrangement causes the solid-liquid suspension entering through the inlet 88 to lose liquid and therefore to exit through the outlet end 90 more dense than at the inlet. The solid-liquid suspension exiting the head box 36 and entering the inlet 88 of the wedge portion 16 will be referred to herein as the primary solid-liquid suspension and the one exiting the outlet 90 will be referred to as the secondary solid-liquid suspension.

Other biasing means than the bent end 96 of the transversal beams 94 can be provided, such as springs and/or angle iron (both not shown).

According to another embodiment (not shown), the wedge area is defined by first and second series of rolls mounted respectively to the top and bottom frame 44 and 46.

The proximate end of each of the top and bottom support assemblies 44 and 46 is provided with a tension roll assembly 48 which contribute to tensioning the webbings 12 and 14. Each tension roll assembly 48 includes a roll 50 in contact with the respective webbing 12 and 14 and being selectively biased from a respective support assembly 44 or 46 by a cylinder 52.

In addition to their tensioning function, the tension roll assemblies 48 directs respectively the top and bottom endless webs 12 and 14 into the wedge area 17 for movement from the inlet 88 to the outlet 90 thereof.

As will be described hereinbelow with reference to a further embodiment, the two tension roll assemblies 48 need not to be identical and may also be mounted differently to the primary dewatering section 16. The tension on the webs 12 and 14 is adjusted by a human operator (not shown) after visualizing loosening of the webs by operating the roll assemblies 48. According to a further embodiment (not shown), a web tension sensor is provided which is coupled to the tension assemblies so as to trigger and command their operation. The two tension assemblies 48 are independently operable.

A liquid outlet 54 is secured to the bottom support assembly 46 to recuperate liquid extracted in the wedge area 17. Liquid is also recuperated under the secondary and tertiary dewatering sections 18 and 26. Additional liquid recuperating means such as recipients (not shown) can further be provided under the primary dewatering section 16.

Top and bottom web alignment assemblies 56 are mounted to respective top and bottom support assemblies 44 and 46 of the primary dewatering section 16. Top and bottom web alignment assemblies 56 allow aligning respectively the top and bottom webs 12 and 14 during operation.

The web alignment assembly 56 includes a guiding roll 58 and two lateral air balloons 60 which offset the roll 58 as required in order to keep the respective web 12 and 14 centered. The pair of air balloons 60 is responsive to a feedback sensor 62 mounted to the support assembly 44 or 46 adjacent the web alignment assembly 56.

Other sensor technologies can be used detect the misalignment of the webs 12 and 14 such as without limitation optical sensors.

Similarly, other centering mechanisms than a roll with lateral balloons can be used.

The primary dewatering section 16 also includes two shower stations 64, each mounted to a respective support assembly 44 and 46 on the side of the web 12 and 14 opposite the respective support assembly 44 and 46. The showers 64 are position upstream from the wedge area 17 relative the movement of the webs 12 and 14. The shower stations 64 include perforated tubing (not shown) fed by a pressurized web cleaning fluid distribution system (not shown) which creates cleaning jets onto the web 12 and 14. The tubing is positioned transversally the orientation of the webs 12 and 14 and has a length or configuration allowing to spread the cleaning fluid along its width. According to the first embodiment, the cleaning fluid is water. However, the cleaning fluid can be another liquid depending for example on the solid-liquid suspension and/or the web material. According to other embodiment of the present invention, the shower station 64 includes sprinklers, water nozzles or another fluid distributing mechanism (not shown).

Figure 6:
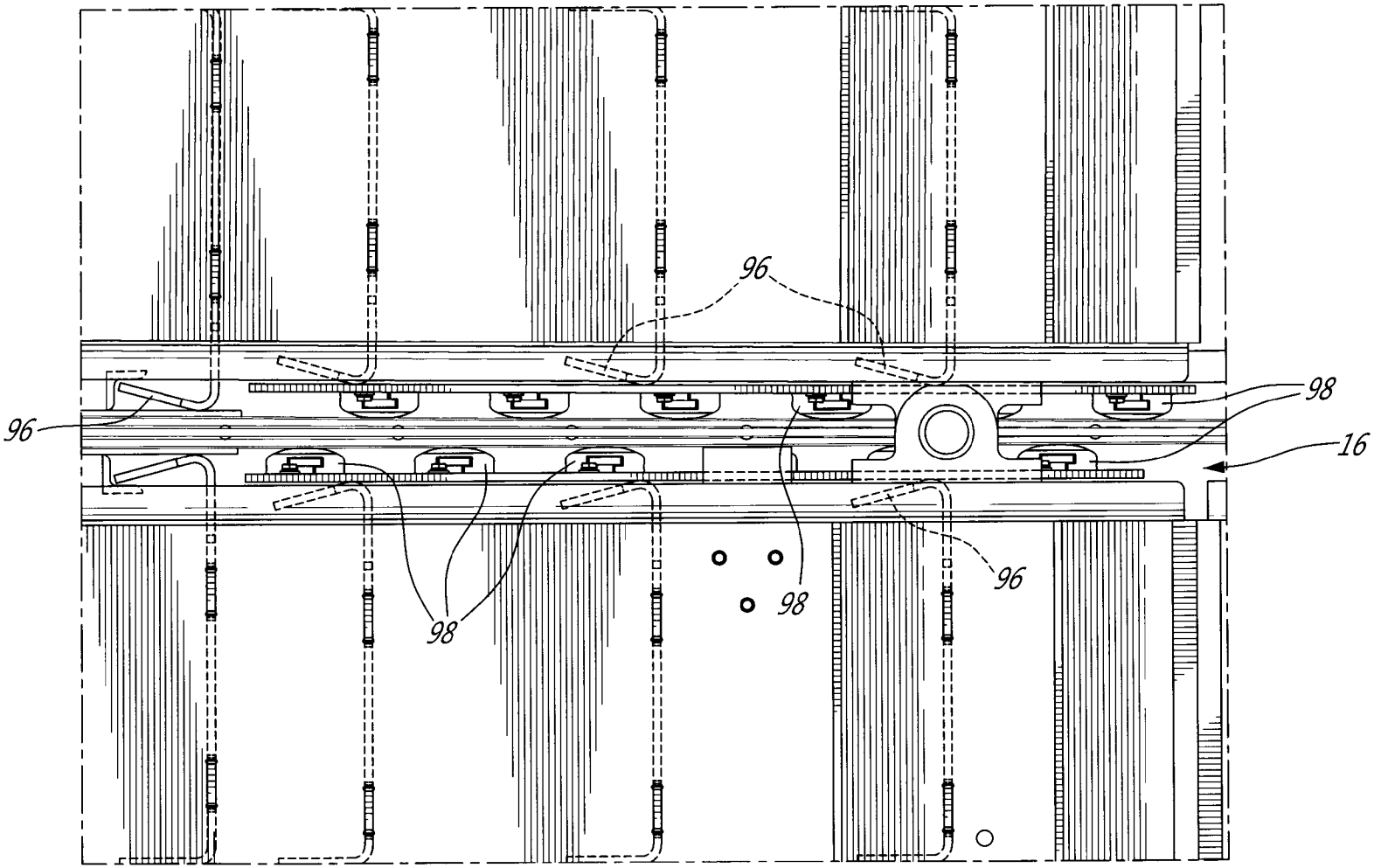
FIG. 6 is a close up view taken within lines 6-6 in FIG. 1, illustrating the shoe assembly which is part of the primary dewatering section.

Turning briefly to FIG. 6, the wedge area 17 is further provided with excess water removal elements 66 near the outlet 90 thereof. According to the first embodiment, these elements 66 are in the form of friction shoes 98 made for example of a polymeric material and that are alternatively secured to the top and bottom support assemblies 44 and 46. In diminishing the height of the interspace 17, the friction shoes 98 provide additional friction onto the webs 12 and 14 and therefore increase the water extraction from the solid-liquid suspension. This allows for example increasing the treatment speed of the apparatus 10 and more specifically the speed of displacement of the webs 12 and 14.

The water removal elements can be provided alternatively or in addition to the static sheets 40 and 42. According to a further embodiment, the excess water removal elements differ to those illustrated. According to still another embodiment, the excess water removal elements 66 are omitted.

The secondary solid-liquid suspension that enters the secondary dewatering section 18 exits in the form of a tertiary solid-liquid suspension which has an increased density compared to the secondary solid-liquid suspension.

The grooved rolls 20-24 of the secondary dewatering section 18 have gradually decreasing diameter from the primary dewatering station 16 to the tertiary dewatering section 26 so as to provide an increasing pressure onto the pulp as it advances through the section 18 and as it gains consistency.

According to a further embodiment (not shown), the grooved rolls 20-24 have the same diameter or show a diameter pattern different than the one according to the first embodiment. According to another embodiment (not shown), the rolls 20-24 are not grooved. According to still another embodiment, the first roll 20 is mounted to the top frame 44 of the primary dewatering section 16.

Each of the four press roll assemblies 28-34 has a scissor nip configuration. The assemblies 28-34 allow removing additional water from the pulp as increasing pressure is applied onto the pulp material running therein. Even though the pair of rolls from each assembly 28-32 is illustrated as having regular rolls, grooved rolls can also be used in these assemblies.

The rolls 68 and 70 from the last assembly 34 further act as energized rotating rolls to drive the top and bottom webs 12 and 14 respectively. According to another embodiment (not shown), a driving roll assembly is mounted to or positioned adjacent the tertiary dewatering section 26 to cooperate with the tension roll assembly 48 so as to drive the top and bottom webs 12 and 14. According to still another embodiment, the tertiary dewatering section 26 includes two or more drive roll assemblies (not shown).

The number of press roll assemblies may vary depending for example on the application and/or on the speed of the webs 12 and 14.

The assembly 28 will now be described herein in further detail. Since the assemblies 30-34 are similar in configuration to the assembly 28, and for concision purposes, they will not be described herein in more detail.

The assembly 28 includes a first roll 72 rotatably mounted to the bottom frame 38 thereonto. For that purpose, the bottom frame 38 includes two opposite arcuate notches 74 (only one shown) for receiving the longitudinal ends of shaft 76 of the first roll 72.

The assembly 28 further includes a second roll 78 mounted to the first roll 72, on top thereof in a scissor nip configuration, via a mounting assembly 80. The mounting assembly 80 includes two end plates 82 (only one shown), each rotatably mounted at a respective longitudinal end of the second roll 78. Each end plate 82 is pivotally mounted to the bottom frame 38 via a pivot rod 84 (only one shown). The assembly 28 further includes a pneumatic or hydraulic cylinder 86 for applying a selected pressure between the two rolls 72 and 78. The cylinder 86 is pivotally mounted to both the frame 38 and the plate 82 therebetween.

Whenever maintenance is to be performed on any one of the rolls 20-24 and the ones in the assemblies 28-34, an overhead crane can for example be used since no frame structure is provided on top thereof. Each of the rolls 20-24 and the rolls from the assemblies 28-34 are demountable independently from the other. Maintenance of the secondary and tertiary sections 18 and 26 of the press 10 is therefore facilitated.

It is to be noted that the alignment of the press rolls in the assemblies 28-34 is achieved through the machining of the rolls support.

Even though the twin wire press 10 is illustrated as having a single support frame 38 supporting the headbox 36, primary, secondary and tertiary dewatering sections 16, 18 and 26, each of these assemblies 36, 16, 18 and 26 can be mounted onto individual frames (not shown) which are then assembled before operation.

Also, even though the support frame 38 is illustrated as being part steel and part concrete, a support frame according to another embodiment of the present invention can be made completely of steel.

It is to be noted that modifications can be made to the press 10 such as:

- the number of rolls in the secondary or tertiary dewatering sections 18 and 26 may vary;
- the primary, secondary or tertiary dewatering sections 16, 18 and 26 can be provided with different pulp treating devices or mechanism in addition or alternatively to those illustrated in FIGS. 1 to 3;
- the press 10 can be provided with other web aligning mechanism than the one illustrated in FIGS. 1 to 3 and described hereinabove. For example a crowned roller (not shown) can be used. In some applications, the web-aligning mechanism is omitted;
- the press 10 can be provided with other web tensioning mechanism than the illustrated tension roll assembly 48. Depending on the application, the tension roll assembly may not be configured to tension the webs 12 and 14 and may only serve the purpose of directing the webs 12 and 14 in the wedge area;
- in some applications, the excess water removal elements 66 can be omitted;
- in some applications, a single one of the secondary and tertiary dewatering sections 18 and 26 is required;
- in some applications, the secondary and tertiary dewatering sections 18 and 26 can have their position swapped;
- shall the secondary dewatering section 18 be the last one in the dewatering process, a drive roll assembly is further provided for driving the endless webs 12 and 14.

Figure 7:
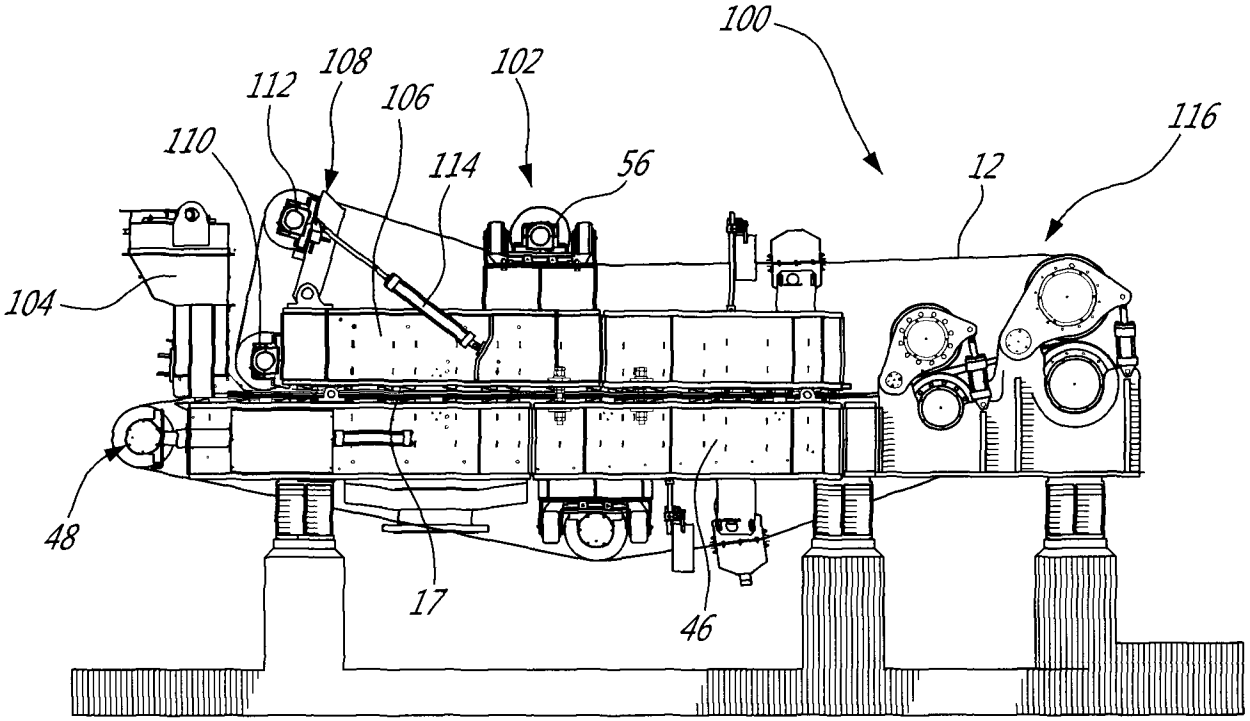
FIG. 7 is a side elevation of a twin wire press according to a second embodiment of the present invention.

A twin wire press 100 according to a second embodiment will now be described with reference to FIG. 7. Since the twin wire press 100 is similar to the twin wire press 10, only the differences between the two presses 100 and 10 will be described herein.

A first difference between the presses 100 and 10 is that the secondary dewatering section 19 is omitted and the tertiary dewatering section 116 is positioned adjacent the primary section 102. Also, the section 116 includes two pairs of rolls in a scissor-nip configuration compared to the section 26 which includes four pairs.

Also, the head box 104 is in the form of a medium consistency headbox positioned over the bottom support frame 38 upstream from the wedge area 17 so as to drop by gravity the primary solid-liquid suspension (not shown). The top support frame 106 is shorter than the bottom support frame 46 on the inlet side so as to accommodate the head box 104 therein.

Also, the tension roll assembly 108 of the top portion of the primary dewatering section 102 differs than the one 48 mounted to the primary dewatering section 10.

Indeed, since the roll assembly 108 is positioned upstream from the wedge area 17 and downstream from the head box

104, the tension roll assembly 108 comprises two rolls 110 and 112 for directing the top web 12 from the top web aligning system 56 into the wedge area 17. The higher roll 112 allows bending the top web 12 and redirecting it towards the lower roll 110 which has a lower edge at the wedge area level. A cylinder 114 is mounted to the higher roll 112 and to the top support frame 106 therebetween for allowing selective biasing of the roll 112 relative to the frame 106 thereby allowing tensioning of the top web 12.

The expression "excess water removal elements" and "dewatering" should not be construed as being limited to water removal and is intended to mean removal of any liquid in a solid-liquid suspension.

Twin wire presses according to embodiments of the present invention can be used to remove liquid in a suspension such as a pulp suspension in the paper industry or the juice industry and can be used in sludge treatment for example to produce biofuel.

Although the present invention has been described hereinabove by way of illustrated embodiments thereof, it can be modified without departing from the spirit and nature of the subject invention, as defined in the appended claims.

The invention claimed is:

1. A twin wire press comprising top and bottom endless wires for separating solid and liquid from a primary solid-liquid suspension, the twin wire press comprising:

a web formed between said wires;

a support frame;

a first dewatering section mounted to the support frame and including a wedge interspace area which has an inlet and an outlet; the first dewatering section further including first and second tension roll assemblies mounted to the support frame upstream the wedge interspace inlet for directing respectively the top and bottom endless wires into the wedge interspace for movement from the inlet to the outlet thereof; the wedge interspace acting on the top and bottom wires in movement therein for collecting a first quantity of liquid from the primary solid-liquid suspension received therein so as to yield at the outlet a secondary solid-liquid suspension which is denser than the primary solid-liquid;

a secondary dewatering section mounted to the support frame adjacent the outlet of the first dewatering section for receiving the secondary solid-liquid suspension therefrom; a press roll assembly mounted on the support frame; the top and bottom wires cooperating in movement with the press roll assembly to further extract liquid from the secondary solid-liquid suspension to yield a tertiary solid-liquid suspension;

a drive roll assembly mounted to the support frame that cooperates with first and second tension roll assemblies to move the top and bottom wires from the inlet of the wedge interspace to the second dewatering section via the outlet of the wedge interspace then back to the inlet of the wedge interspace; and wherein said press roll assembly comprises a first press roll rotatably mounted to the support frame, a second press roll mounted onto the first roll for rotation in unison with the first roll via i) two longitudinal end plates that are pivotably secured to the support frame at a respective longitudinal end thereof and ii) at least one cylinder having a fixed end secured to the support frame and a working end secured to one of the longitudinal end plates for biasing the second roll toward the first roll and for applying pressure therebetween.

2. A twin wire press as recited in claim 1, wherein the drive roll assembly is part of the press roll assembly.

3. A twin wire press as recited in claim 1, wherein the first and second press rolls apply increasing pressure onto the secondary solid-liquid suspension along a direction of movement of the top and bottom wires.

4. A twin wire press as recited in claim 1, wherein the first and second tension rolls are further configured so as to allow adjusting tensions in the top and bottom endless wires respectively.

5. A twin wire press as recited in claim 1, further comprising top and bottom wire alignment assemblies mounted to the support frame for detecting a misalignment of the top and bottom wires respectively and for selectively aligning one of the top and bottom wires should the misalignment of the one of the top and bottom wires be detected.

6. A twin wire press as recited in claim 1, further comprising top and bottom shower stations mounted to the support frame for providing web cleaning fluid onto respectively the top and bottom wires upstream from the first dewatering station.

7. A twin wire press as recited in claim 1, wherein the primary solid-liquid suspension is fed to the inlet of the wedge area of the primary dewatering section by a headbox.

8. A twin wire press as recited in claim 7, wherein the headbox is a pressurized headbox or a medium consistency headbox.

* * * * *